United States Patent [19]

Bucher

[11] Patent Number: 4,915,144

[45] Date of Patent: Apr. 10, 1990

[54] DELIVERING YARNS WITH AN EXCESS LENGTH FROM A YARN STORE IN AN AIR JET MULTICOLOR LOOM

[75] Inventor: Robert Bucher, Frick, Switzerland

[73] Assignee: Sulzer Brothers Limited, Winterthur, Switzerland

[21] Appl. No.: 209,898

[22] Filed: Jun. 22, 1988

[30] Foreign Application Priority Data

Jun. 25, 1987 [CH] Switzerland ..... 02391/87

[51] Int. Cl.[4] ..... D03D 47/36

[52] U.S. Cl. ..... 139/453; 139/435.1; 139/452

[58] Field of Search ..... 139/435, 453, 452

[56] References Cited

U.S. PATENT DOCUMENTS 4,542,772 9/1985 Gaschutz ..... 139/435
4,559,976 12/1985 Araki et al. ..... 139/435
4,601,314 7/1986 Gunneman ..... 139/435 X
4,620,570 11/1986 Suzuki ..... 139/435
4,716,943 1/1988 Yoshida et al. ..... 139/453 X
4,756,342 7/1988 Van Bogaert ..... 139/435

FOREIGN PATENT DOCUMENTS 2556749 6/1985 France .
2151266A 7/1985 United Kingdom .

*Primary Examiner*—Andrew M. Falik
*Attorney, Agent, or Firm*—Burns, Doane, Swecker & Mathis

[57] ABSTRACT

In a multicolor air jet loom, a weft color which because of its long weft yarn repeat does not require picking for a considerable period of time and whose free end is damaged by the retaining air flow in the picking nozzle, is picked with an excess length equal to the damaged yarn part in the nozzle. The damaged portion of yarn is therefore not woven in and the resulting cloth has a defect-free edge zone.

13 Claims, 4 Drawing Sheets

DELIVERING YARNS WITH AN EXCESS LENGTH FROM A YARN STORE IN AN AIR JET MULTICOLOR LOOM

FIELD OF THE INVENTION

The invention relates to a method of picking weft yarns in an air jet multicolor loom and to apparatus for carrying out the method.

In such multicolor looms, there is a yarn store for each weft color, and a weft yarn of a particular color having a long repeat will be inserted into the shed during some but not all "picks" or loom cycles. In the intervals between the actual insertions of a particular yarn, that yarn is retained by means of a yarn stopper and maintained stretched by a retaining air flow in a picking channel of a multicolor picking nozzle. The present invention is concerned with avoiding fabric defects which might result from deterioration (e.g. untwisting) of the quality of a weft yarn end portion subjected for too long a time to the retaining air flow in a picking channel of the nozzle.

BACKGROUND

In an air jet loom a weft yarn not required to be picked for the time being can be stopped or retained by means of a yarn stopper and its free end maintained stretched in the picking nozzle by means of a retaining air flow. Weft yarn can be stopped by a separate stopper or by means of a finger stopper on the particular yarn store concerned.

In the production of multicolored cloth one weft color may not have to be picked for a long time and may therefore be damaged by the retaining air flow during this time. Occasionally the weft yarn end portion in the nozzle may be untwisted or disassociated by the retaining air flow. Also, the yarn clamp or finger stopper may leave marks on the yarn end. These tendencies toward deterioration of the weft yarns held in readiness for later insertion into the shed of an air jet multicolor loom are threats to the maintenance of high quality in the fabric being woven. The damaged end portion of a weft yarn would, in the conventional weaving method, result in a defect in the edge zone of the cloth at the side of the loom opposite the picking nozzle.

OBJECT AND SUMMARY OF THE INVENTION

It is an object of the invention to provide a method and apparatus which obviates the occurrence of a defective fabric edge zone on the side of a multicolor cloth opposite the picking nozzle. According to the invention, a weft yarn, which according to the pattern being woven is not inserted into the shed for a long interval of time, is delivered by its weft yarn store in an excess length at least equal to the yarn length retained in the picking channel of the picking nozzle. This excess length is such that the yarn end portion which might have been damaged in the course of its being maintained for a long time in readiness for picking does not become a part of the fabric being woven. Instead this end portion is cut off and discarded.

The gathering, severing, and disposition of the extra length of weft yarn in excess of the amount required by the width of the fabric being woven may take place either on the side of the loom where the picking nozzle is located or on the opposite side of the loom.

BRIEF DESCRIPTION OF THE DRAWINGS

Some embodiments of the subject of the invention will be described hereinafter with reference to the drawings wherein.

DETAILED DESCRIPTION OF PREFERRED EMBODIMENTS

Figure 1:
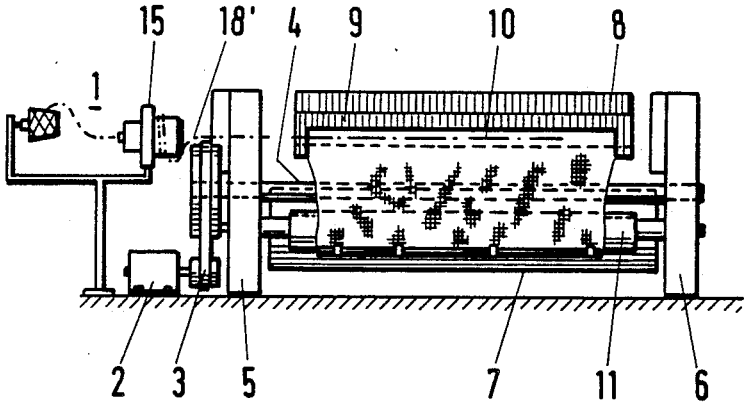
FIG. 1 is an overview of an air jet multicolor loom.

Referring to FIG. 1, a weft yarn delivery facility 1 is shown on one side of an air jet multicolor loom. Disposed on the same side is a driving motor 2 which by way of a belt drive 3 drives main shaft 4 of the loom. Shaft 4 is mounted in two uprights 5, 6 one on each side of the loom. The warp beam 7, shafts 8, reed 9, cloth 10 and cloth beam 11 may be located at their usual positions in looms of this type.

Figure 2:
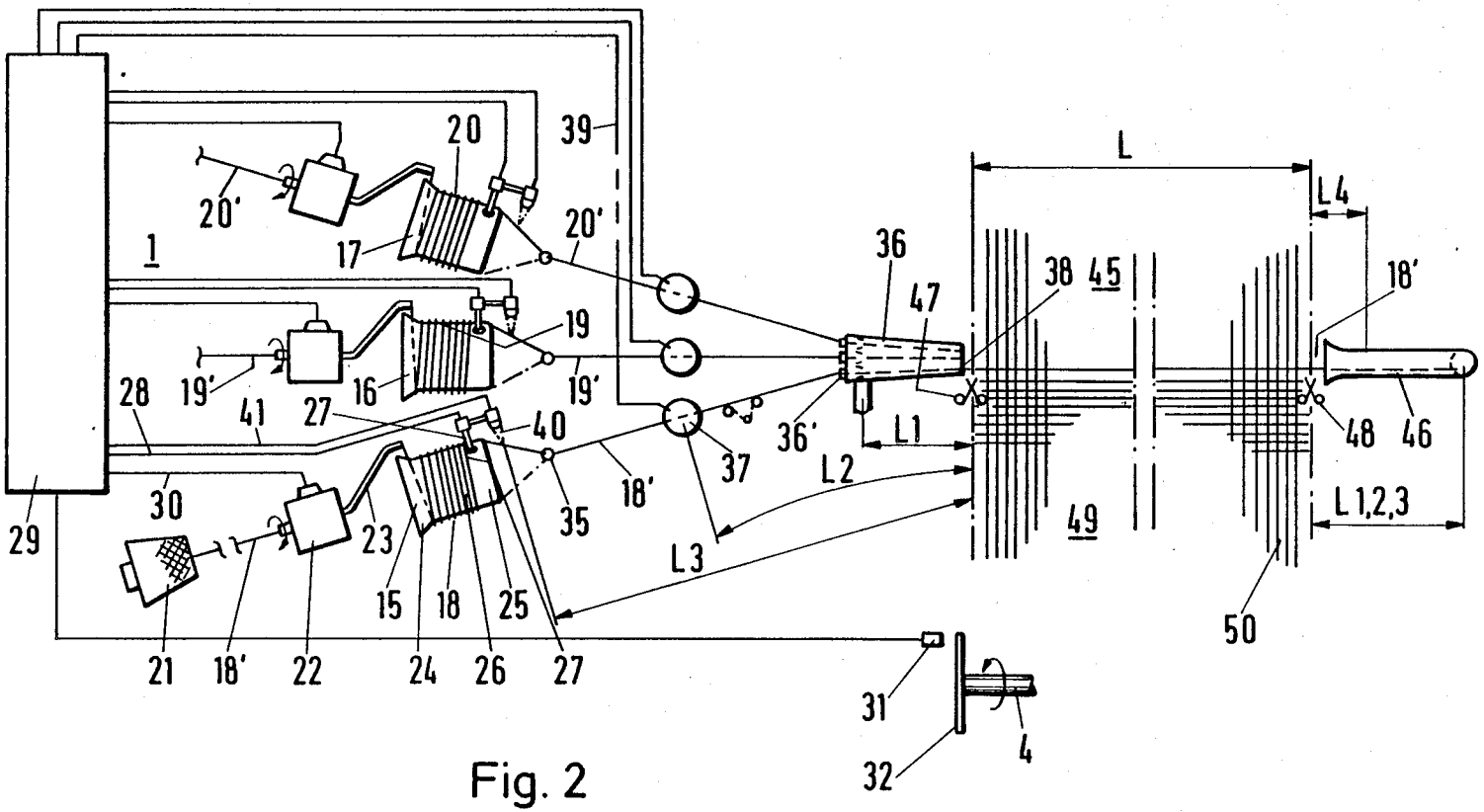
FIG. 2 is a diagrammatic plan view of the loom.

As can be gathered from FIG. 2, a weft yarn delivery facility 1 comprises three yarn stores 15, 16, 17, storing a respective weft yarn 18, 19, 20, hereinafter called weft colors 18', 19', and 20' respectively. Each weft yarn store draws its weft color off a supply bobbin; for example, the weft store 15 draws the weft color 18' from a supply bobbin 21.

Suitable yarn store constructions are known in the art and need not be described here in detail. See, for example, the yarn store disclosed in U.S. Pat. No. 4,407,336, issued Oct. 4, 1983, the disclosure of which is incorporated herein by reference.

The weft color 18' goes through a bore in a yarn winder 22 and winding tube 23 thereof. The rotating tube 23 winds weft color 18' on a conical part 24 of a stationary drum 25 of yarn store 15, the input turns of the weft color 18' sliding consecutively off the conical part 24 and on to the drum 15 to form a yarn supply 26 thereon.

A retaining pin 27 secures the yarn supply 26 from slipping off until the time when it is picked into the loom. A pattern-programmed control facility 29 controls pin 27 by way of a control line 28 and, by way of a control line 30, the rotation of the tube 23. The control facility 29 is synchronized with the loom by means of an inductive sensor 31 which cooperates with a control disc 32 disposed on the loom main shaft 4.

The weft color 18' which comes off the drum 25 and passes through a yarn guide 35 goes to a multiple picking nozzle 36 and a length L1 of the weft color 18' is kept stretched in nozzle 36 by means of a retaining air flow in a picking channel 36' until the next pick.

There is a length L2 of yarn present between outlet 38 of picking channel 36' and a yarn stopper 37. The control facility 29 controls the stopper 37 by way of a line 39.

When the weft color 18' is retained on the drum 25 by means other than the separate stopper 37, the store 15 has a finger stopper 40 controlled by way of a line 41 by the control facility 29. There is a length L3 of yarn present between outlet 38 of picking channel 36' and the finger stopper 40.

If the waiting time between two picks is long, the weft color yarn length L1 experiences the detrimental effect of the retaining air flow. If the weft color is a yarn which untwists readily, the damage may continue over the length L2 to the yarn stopper 37 or over the length L3 to the finger stopper 40. Also, the yarn lengths L2 and L3 may have clamp marks because of the pressure of the yarn stopper or finger stopper.

To explain the method used it will be assumed that only the weft yarn 18' is required not to be picked over a long period of time. It will also be assumed that the weft color 18' has been damaged only over the length L1. The weft colors 19' and 20' are picked regularly, for example, alternately. When it is required to pick the weft color 18', the air pressure in the nozzle 36 is increased from the retaining pressure to the picking pressure. Also, the control device 29 acts to raise the retaining finger 27 on the yarn store 15 so that the yarn supply 16 thereon is released. The control facility 29 also raises the yarn stopper 37 and picking begins. The control facility 29 is so programmed that the yarn store 15 releases a yarn length equal to the weaving width L plus L1 in the nozzle 36. The length L1 is therefore an excess length. Nozzle 36 then picks weft color 18' into shed 45, the excess length L1, being picked first. The excess length L1 is received by stretching nozzle 46 on the "catching" side of the loom, that is, the side opposite that at which the picking nozzle is located. The weft color is then parted off or cut by shears 47, 48 on either side of the shed 45 and beaten up by the reed 9. Consequently, the damaged length L1 is not woven into the cloth 49 and so its edge zone 50 remains flaw-free. The severed excess length L1 is removed by the nozzle 46. As will be apparent, the loss length-i.e., the length L4 of the weft color which is always inevitably lost-is contained in the excess length L1. The actual length of waste yarn is therefore only L1–L4.

If the weft color 18' has been damaged over the length $L_2$ or $L_3$, it is picked in the manner described with this excess length. The same is again received in the nozzle 46 and kept stretched until severed by the shears 48.

Instead of the weft color excess length L1, L2 or L3 being severed on the catching side of the loom after picking, the excess length can be severed before picking and entry into the shed. Devices for this purpose are shown in FIGS. 3–6.

Figure 3:
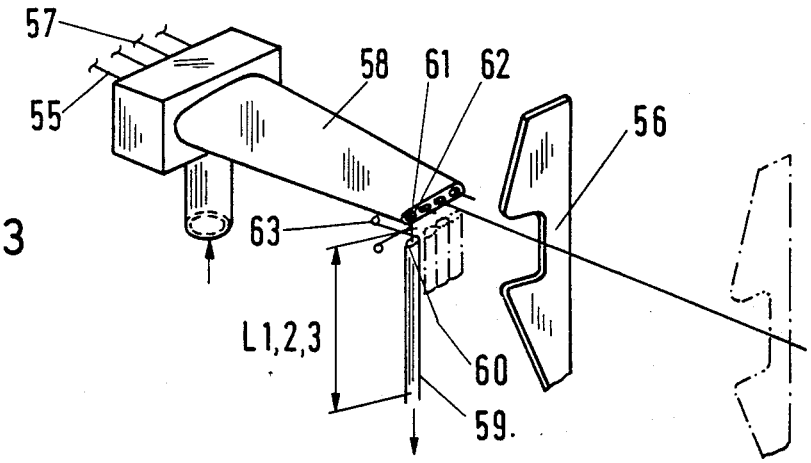
FIG. 3 shows one embodiment of the weft yarn delivery facility.

In the embodiment shown in FIG. 3 it is assumed with regard to a weft color 55 that the same is to be picked into the shed (bordered at the rear by a tunnel reed diagrammatically represented by reed dent 56) with an excess length L1. The other weft colors, for example, 57, are to be picked without excess length.

A suction tube 59 is placed vertically at the end of a picking nozzle 58, and its inlet 60 extends to just below an outlet 61 of a picking channel 62 of the nozzle. Shears 63 are disposed between the picking channel outlet 61 and the suction tube inlet 60.

When it is required to pick the weft color 55, the control facility 29 so controls the yarn store 15 that the same first releases the excess length L1. However, as soon as the excess length L1 leaves the picking channel outlet 61, it is drawn into the suction tube inlet 60 and carried away through the suction tube 59. After the excess length L1 has been taken up into the suction tube 59, it is severed by the shears 63. The control facility 29 now acts so that the yarn store 15 releases the complete length of weft color for picking. The stretching nozzle on the catching side receives the normal waste length L4 of the weft color. The procedure just described is of course the same when it is required to pick the weft color 55 with an excess length L2 or L3.

It is not necessary for the excess length to be removed and severed just before the picking of the weft color. The removal and severance can occur during an earlier weaving cycle. The control facility controls the yarn store appropriately for this purpose.

The suction tube 59 can be movable along the nozzle 58 so that it can be assembled as required adjacent whichever picking channel carries a weft color that is not inserted into the shed often enough to obviate a risk of damage. Of course, a suction tube which can be supplied with a negative pressure as required can be disposed before each picking channel if desired.

Figure 4:
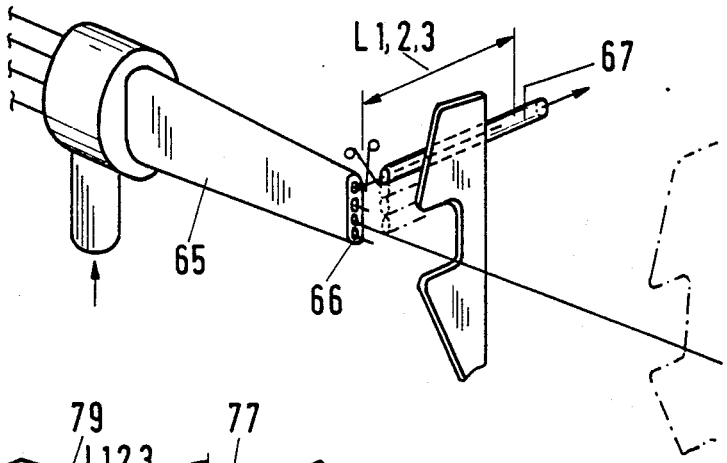
FIG. 4 shows a variant of FIG. 3.

The embodiment of FIG. 4 shows a picking nozzle 65 having picking channels 66 disposed one above another. Correspondingly, one or more suction tubes 67 extends or extend horizontally. Operation is the same as described with reference to FIG. 3.

Figure 5:
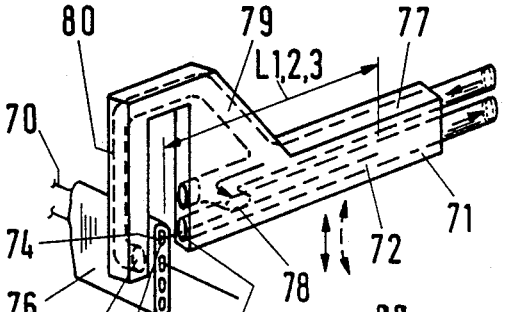
FIG. 5 shows another embodiment.
Figure 6:
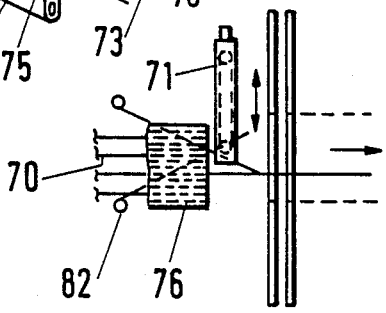
FIG. 6 is a plan view corresponding to FIG. 5.

In the embodiment shown in FIGS. 5 and 6 the weft color to be deflected is sucked in by a suction tube and simultaneously deflected in the same direction by a blowing tube. This will be explained with reference to a weft color 70.

A block 71 has a suction channel 72 whose inlet 73 is disposed before an outlet 74 of a picking channel 75 of a picking nozzle 76. Blowing air flows into the block 71 through a second channel 77. The blowing air flows through a branch 78 into the suction channel 72 and produces suction by aspirator effect at suction channel input 73. A second branch 79 from the channel 77 extends through a blowing tube 80 which extends over the picking nozzle 76 to an outlet 81 facing the inlet 73 of the suction channel 72 on the other side of the picking channel 75.

The excess length L1 of the weft color 70 required to be deflected and removed is engaged, as it leaves the picking channel 75, simultaneously by the blowing air from the blowing tube 80 and by the negative pressure at inlet 73 of suction channel 72. This causes it to move into the channel 72. Once the excess length L1 has been taken up, it is severed by shears 82. Then the weft color 70 is picked.

The present invention is useful in the weaving of many different patterns. However, it will be useful to consider here, as an illustrative example, the sequence of events associated with the weaving of one such pattern.

Figure 7:
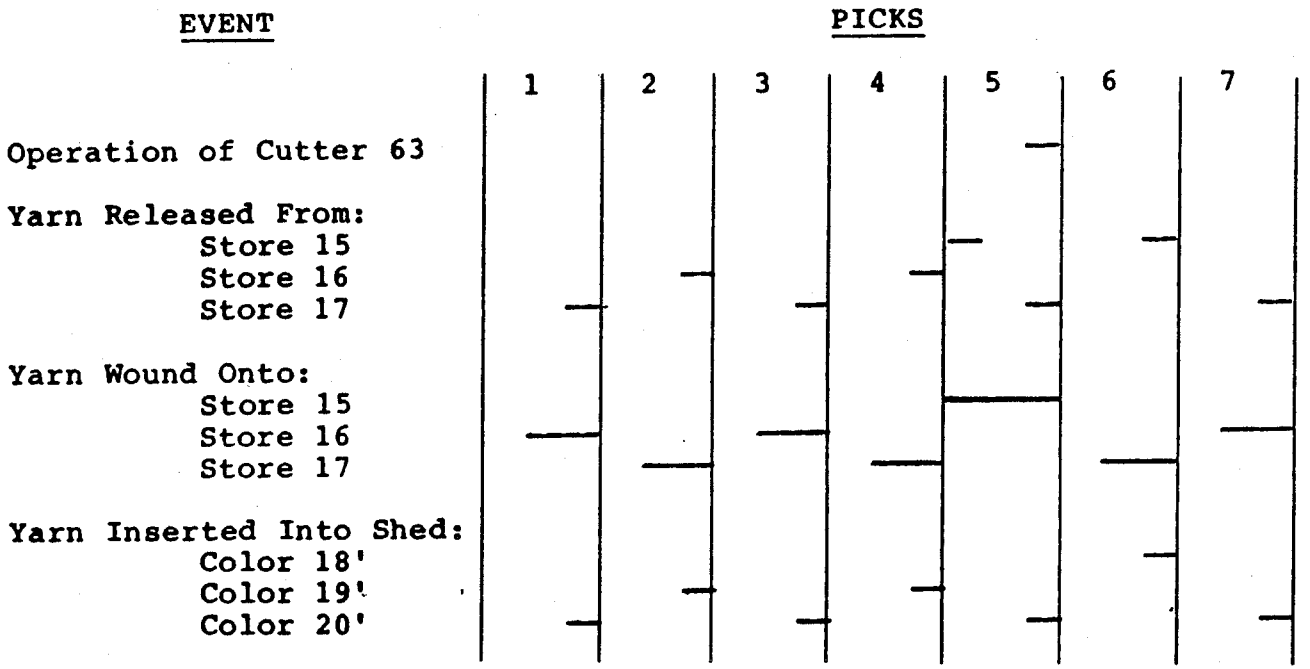
FIG. 7 is a diagram indicating actions which take place during successive picks when a particular illustrative pattern is being woven using apparatus of the type depicted in FIG. 3.

Referring to FIG. 7, it is to be understood that the pattern is one having a weft color repeat sequence of six picks in the sequence: 20', 19', 20', 19', 20', and 18'. In this pattern, weft color 18' remains idle longer than either of the other colors and has more opportunity for deterioration under the influence of the retaining air flow in the picking nozzle. In accordance with the present invention, a length L1 from the end portion of weft color 18' is discarded so as not to risk fabric defects.

Apparatus suitable for the FIG. 7 sequence of operations would be one, such as shown in FIG. 3 for example, where the excess yarn length is deflected away at the left side of the loom prior to its insertion into the shed.

During the first pick of the FIG. 7 sequence, the weft color 20' is removed from its store 17 and inserted into the loom shed. This is accomplished by activating the picking jet and releasing the retaining pin 27 at store 17. The length which is removed from the store and inserted into the shed is the normal weft pick length appropriate for the width of the cloth being woven. Also during pick number one, the rotating tube 23 for yarn store 16 winds weft color 19' onto that store to provide there a length sufficient for a normal pick. Weft color 18' is idle during this time.

During pick number two in FIG. 7, weft color 18' remains idle, weft color 20' is wound onto its store, and weft color 19' is released from its store and inserted into the shed.

Pick number three in FIG. 7 is the same as pick number one, and pick number four is the same as pick number three.

In pick number five, a normal pick length of weft color 20' is again released from its store and inserted into the shed. Additionally, a number of actions take place with regard to weft color 18'. The rotating tube 23 for yarn store 15 operates to input a length of weft yarn equal to a normal pick length plus an extra length L1. A length L1 is released from the store 15 for deflection into suction tube 59 early on during pick number five and this length is parted off or cut later during the same pick interval number five, so that it will be removed from the active weaving area.

During pick number six, the weft color 18' (from which the possibly defective leading end has just been removed) goes through a normal insertion in which a normal pick length is removed from the store 15 and inserted into the shed. Also, weft color 20' is supplied to its store 17 so that it will be available for picking during the next weaving cycle. In FIG. 7, pick number seven represents the first pick in the next repeat of the pattern. It is the same as pick number one.

A similar pattern can of course be produced when the excess length of the less used color 18' is accommodated on the right side of the loom opposite the picking nozzle. In this case, it would not be necessary to release the length L1 of color 18' during pick number five; the total of L1 plus a normal pick length could be released from the store 15 during pick number six and the operation of the cutter 48 at the right side of the loom would provide for disposition of the extra, possibly damaged, weft end portion.

While the invention has been described with particular reference to certain embodiments illustrated in the drawings, other variations and modifications will occur to persons skilled in the art. Accordingly, it is intended that the foregoing description be viewed as exemplary and that the scope of the invention be ascertained from the following claims.

What is claimed is:

1. A method of picking weft yarns into an air jet multicolor loom in which there is a yarn store for each weft color, a weft yarn of a particular color which is to be picked being retained before picking and being maintained stretched by a retaining air flow in a picking channel of a picking nozzle, characterized in that a weft yarn having a long repeat is released by its corresponding weft yarn store to the picking channel in an excess of length at least equal to the yarn length maintained stretched in its picking channel before picking by said retaining air flow.

2. A method according to claim 1, wherein said weft yarn having a long repeat is retained by means of a yarn stopper between the yarn store and the picking nozzle, and wherein the excess length is equal to the length of the weft yarn between the outlet of the picking channel and the associated yarn stopper.

3. A method according to claim 1, wherein said weft yarn having a long repeat is retained by means of a finger stopper on its associated yarn store, and wherein the excess length is equal to the length of the weft yarn between the outlet of the picking channel and the finger stopper on said yarn store.

4. A method according to claim 1 wherein the excess length of weft yarn is cut off on the opposite side of the loom from the picking nozzle after the picking of the weft yarn into the shed.

5. A method according to claim 1, wherein the excess length of weft yarn is deflected from the direction of the picking nozzle axis on the same side of the loom as the picking nozzle, cut off and removed before the picking of the weft yarn into the shed.

6. A method according to claim 5, wherein the excess length of weft yarn is deflected and cut off before the weaving cycle during which the picking of the weft yarn into the shed occurs.

7. An air jet multicolor loom for performing the method according to claim 5 comprising:

one weft yarn store per weft color;

multiple picking nozzle means in which the weft yarns are retained each by a retaining air flow in a picking channel before being picked;

yarn stoppers to retain the weft yarns;

a suction tube disposed outside the outlet of the picking nozzle channel for a long-repeat weft yarn color, the suction tube extending transversely to the picking nozzle and having an inlet disposed near the picking channel outlet for receiving a length of the long-repeat weft yarn color prior to picking of such long repeat weft yarn color; and parting off means for said weft yarn disposed between the picking channel outlet and the suction tube inlet.

8. A loom according to claim 7, wherein said suction tube is displaceable relative to the picking channels so that it may be moved into position to cooperate with a selected one of said channels.

9. An air jet multicolor loom comprising:

one weft yarn store per weft color;

multiple picking nozzle means in which the weft yarns are retained each by a retaining air flow in a picking channel before being picked;

yarn stoppers to retain the weft yarns;

a suction tube disposed outside the outlet of the picking nozzle channel for a long-repeat weft yarn color, the suction tube extending transversely to the picking nozzle and having an inlet disposed near the picking channel outlet for receiving a length of the long-repeat weft yarn color prior to picking of such long-repeat weft yarn color;

a blowing tube having an outlet disposed opposite the suction tube inlet; and parting-off means for said weft yarn disposed between the picking channel outlet and the suction tube inlet.

10. A loom according to claim 9, wherein said blowing tube and the suction tube are formed as passages in a block extending transversely to the picking nozzle, with the part of the block having the blowing tube therein extending over the picking nozzle.

11. A loom according to claim 10, wherein the blowing passage communicates by way of a connecting passage with an inlet passage, the same being operative as an air ejector for the suction passage.

12. A loom according to claim 10, wherein the block is displaceable relative to the picking nozzle to position said inlet passage and said blowing passage opposite a different outlet of a picking channel.

13. An air jet multicolor loom comprising:

a plurality of yarn stores including one weft yarn store per weft color;

multiple picking nozzle means in which the weft yarns are retained each by a retaining air flow in a picking channel before being picked;

yarn stoppers to retain the weft yarns;

a suction tube disposed outside the outlet of the picking nozzle channel for a long-repeat weft yarn color, the suction tube extending transversely to the picking nozzle and having an inlet disposed near the picking channel outlet for receiving a length of the long-repeat weft yarn color prior to picking of such long-repeat weft yarn color;

parting-off means for said weft yarn disposed between the picking channel outlet and the suction tube inlet; and control means for controlling the release of yarn from said yarn stores during weaving in a manner such that for each pick of a long-repeat weft yarn color a first length increment of that color is released from its yarn store into said suction tube for parting off and removal and then a second length increment of that long-repeat weft yarn color is released for insertion into the weaving shed by said picking nozzle means.

* * * * *